United States Patent [19]

Oberste-Beulmann et al.

[11] Patent Number: 4,944,558

[45] Date of Patent: Jul. 31, 1990

[54] DRUM CUTTER-LOADER FOR UNDERGROUND MINING

[75] Inventors: Klaus Oberste-Beulmann, Sprockhovel; Herbert Schupphaus, Bochum, both of Fed. Rep. of Germany

[73] Assignee: Gebr. Eickoff Maschinenfabrik u. Eisengiesserie mbH, Bochum, Fed. Rep. of Germany

[21] Appl. No.: 367,045

[22] Filed: Jun. 16, 1989

[30] Foreign Application Priority Data

Jul. 6, 1988 [DE] Fed. Rep. of Germany ..... 3822875

[51] Int. Cl.[5] ..... F21C 25/08

[52] U.S. Cl. ..... 299/42; 299/53

[58] Field of Search ..... 299/29, 42, 43, 45, 299/53, 54

[56] References Cited

U.S. PATENT DOCUMENTS 4,290,652 9/1981 Legrand ..... 299/45

FOREIGN PATENT DOCUMENTS 2425828 12/1975 Fed. Rep. of Germany ..... 299/42
2633544 2/1977 Fed. Rep. of Germany .
3216686 12/1982 Fed. Rep. of Germany .
2732275 1/1983 Fed. Rep. of Germany .
3331920 4/1984 Fed. Rep. of Germany .
1252486 8/1986 U.S.S.R. ..... 299/53

*Primary Examiner*—Jerome W. Massie
*Assistant Examiner*—David J. Bagnell
*Attorney, Agent, or Firm*—Clifford A. Poff

[57] ABSTRACT

In order to overcome problems associated with drum cutter-loader mining machines having a cutting drum mounted at one or both ends of the machine on pivotable support arms and further having cutting drum drive motors positioned outside of the machine body, there is provided a unique support arm system for adjusting the height of the cutting drums and their associated drive motors which neither reduces the debris pass-through cross-section of the machine bridge nor impairs the height adjustability of the cutting drums. The support arm system for each cutting drum and drive motor includes a first support arm section pivotally mounted at one end thereof to an end of the machine body and a second support arm section pivotally mounted to an opposite end of the first arm section. The second support arm section carries at least the cutting drum drive motor at one end thereof and the drive motor of each support arm is positionable inside the coal seam winning track.

20 Claims, 5 Drawing Sheets

DRUM CUTTER-LOADER FOR UNDERGROUND MINING

BACKGROUND OF THE INVENTION

1. Field of the Invention:

The present invention relates to mining machines, in general, and to drum cutter-loader mining machines for underground mining, in particular.

2. Description of the Prior Art:

Through German Offenlegungschrift No. DE-OS 26 33 544 there has become known a mining machine having a first support arm member pivotally mounted at one end thereof to an end of the machine body about an axis which runs at right angles to the longitudinal direction of the machine and is parallel to the mine floor. A second support arm member is pivotally mounted to the free end of the first support arm member about an axis which is parallel the pivoting axis of the first support arm member. The second support arm member is mounted on the side of the first support arm member facing the coal face and carries a cutting drum at each of its two ends. The pivot axis of the second support arm member is located at a position intermediate the spaced cutting drums.

German Offenlegungschrift No. DE-OS 32 16 686 has disclosed a coal-cutting machine having a first support arm pivotally mounted at one end thereof to the machine body with the opposite or free end of the support arm carrying a cutting drum. A second support arm is also carried by the opposite end of the first support arm and it too carries a cutting drum at its free end. Each of the two support arms is equipped with a gear train for transmitting to both cutting drums the driving motion of the motor which itself is housed on the inside of the machine body.

German Patentschrift No. DE-PS 27 32 275 discloses a drum coal cutting machine for the mining of low seams which lie next to the longwall conveyor means and for simultaneously cutting away the mine roof with a "front-running" cutting drum in order to provide free passage of the machine along the mine seam. The machine body is situated in the seam and projects into the coalwinning track but is retained by the longwall conveyor means The machine includes two cutting drums carried above the longwall conveyor means by support arms which are pivotally mounted to the machine body. Also secured to each support arm at a point located behind the cutting drum is a flange-mounted driving motor. By this construction, the axis of the driving motor is spaced from the support arm pivoting axis.

In the case of the mining machine disclosed in German Offenlegungschrift No. DE-OS 33 31 920, however, the motor axis also forms the pivoting axis of the support arm of the cutting drum. The driving motor in this device is connected to the support arm but is mounted inside the machine body so as the be rotatable about its own longitudinal axis.

Because of the narrow spaces which must be navigated in mining underground longwall faces, a premium is placed on keeping the length and height dimensions of the cutter-loader to a minimum. At the same time, however, high driving power is required of the motors which drive the cutting drums in such machines. By necessity, such high-powered motors usually are formed with correspondingly large physical dimensions. In order to avoid increasing the dimensions of the machine body to house the high powered motors, the motors are frequently arranged outside the machine body and fastened to the side walls of the support arms of the cutting drums. When fastened to the support arms, the driving motors may either be situated above the longwall conveyor or arranged in the coal seam winning track behind the cutting drums. In the case of a driving motor which is situated above the longwall conveyor means, there are instances, i.e., the lowest drum positions, wherein the maneuverability or height adjustability of the motor leads to a restriction in the cross-section of the machine bridge through which debris carried by the conveyor must pass. Furthermore, the installation of an auxiliary drum at the leading end of the machine is complicated with such a positioning of the cutting drum drive motor.

It is also possible to position the driving motors in the coal seam winning track behind the cutting drums. However, such positioning of the driving motors is feasible only if it can be assured that a free path for each of the driving motors can be cut by the cutting drums in both directions of travel of the machine. Naturally, the range of vertical adjustability of the cutting drums is considerably restricted by this requirement, particularly if the motor diameters and cutting drum diameters do not differ greatly from one another.

An advantage exists, therefore, for a drum cutter-loader having cutting drum drive motors mounted outside of the machine body which neither reduce the pass-through cross-section of the machine bridge nor impair the height adjustability of the cutting drums.

It is therefore an object of the present invention to provide a cutter-loader mining machine having cutting drum drive motors mounted outside the machine body which do not disadvantageously reduce the debris pass-through cross-section of the machine bridge.

It is a further object of the present invention to provide a cutter-loader mining machine having cutting drum drive motors mounted outside the machine body which do not impair the height adjustability of the cutting drums.

Still other objects and advantages will become apparent when one considers the attached drawings and description of the invention presented hereinbelow.

SUMMARY OF THE INVENTION

The invention relates to a drum cutter-loader for underground mining having a cutting drum mounted at one or both ends of the machine body. The cutting drum or drums are rotatably carried by support arms which are pivotally mounted to the machine body. The support arms are formed of two adjustable inner and outer support arm sections which are pivotally connected together. The inner support arm section of each support arm is pivotally mounted at one end thereof to the machine body. The other "free" end of the inner support arm section pivotally supports an outer support arm section. The pivot axes of the inner support arm section and the outer support arm section extend parallel to one another and transverse to the longitudinal direction of the machine.

In a first embodiment of the invention, the outer support arm section is arranged on the coal face side of the inner arm section and is pivotally supported thereby at a location intermediate the cutting drum and the cutting drum drive motor which are carried at opposite ends of the outer support arm section.

In a second embodiment of the invention, the outer support arm section, which carries a cutting drum and a drive motor at opposite ends thereof, is pivotally supported at one end thereof by the free end of the inner support arm section and is carried at the coal face side of the inner support arm section, whereby the axis of rotation of the cutting drum is coaxial with the pivot axis of the outer support arm section.

In a third embodiment of the invention, the outer support arm section, which carries a cutting drum and a drive motor at opposite ends thereof, is pivotally supported at one end thereof by the free end of the inner support arm section and is carried at the coal face side of the inner support arm section, whereby the axis of the drive motor is coaxial with the pivot axis of the outer support arm section.

In each of the first three embodiments, the drive motors and their respective cutting drums are mounted to the coal face side of the outer support arm sections. And, the drive motors and their respective cutting drums are connected to one another by gearing elements which are housed on the inside of their respective outer support arm section. Also, in each of these embodiments both the cutting drum and the drive motor are arranged on the coal face side of the outer support arm section; and the space in the seam which is cut away by the "leading" cutting drum, depending on the direction of travel of the machine, is used to accommodate the passage of both the "leading" and "trailing" drive motors. In the case of cutting drums having normal dimensions, drive motors of dimensions which have the required driving power can readily be accommodated in the free space in the winning track which exists behind the cutting drum after the drum has cut the seam. Thus, a normal sized "leading" cutting drum cuts free passage space not only for its drive motor but also for the drive motor of the "trailing" cutting drum. The adjustability of both cutting drums is considerably improved by such a design. The improved adjustability is particularly advantageous at the longwall face ends, because at these locations, even in seams of medium thickness, both cutting drums can be retracted, or pivoted inwardly, toward the machine body until they are behind the pivoting axes of their respective outer support arm section Therefore, because of the short overall length of the machine body and the increased cutting drum adjustability provided by the design of the present invention, the length of the floor coal which cannot be reached by the "trailing" drum at a longwall face end is kept to a minimum. Because of the unique design of the present invention, it has been found to be advantageous to provide gearing which acts upon the outer support arm section so as to limit its swivelling range to an angle of 360°. A pivoting range limited in this way gives the cutting drum maximum adjustability on the one hand, but on the other hand limits the twisting of the cable supplying the motor with driving energy. Special measures for supplying the driving energy to the motor are therefore unnecessary, even in the instance when the outer support arm section carries out its largest pivoting movement, i.e., when the mining drift restricting the travel path of the machine also has to be cut with the "leading" cutting drum. If necessary, such a pivoting range further permits the outer support arm section of the "trailing" drum to pivot the "trailing" drum, at the ends of the longwall face where the cutter-loader reverses its direction of travel, into a position in front of its driving motor to cut free passage space therefor upon a reversal of the travel direction of the machine.

In a fourth embodiment of the invention, the outer support arm section is pivotally supported at one end thereof by the free end of the inner support arm section and is carried at the goaf side of the inner support arm section, whereby the axis of rotation of the cutting drum is coaxial with the pivot axis of the outer support arm section.

In the fourth embodiment, the cutting drum is mounted at the coal face side of the free end of the inner support arm and further has an adjustability range extending over the entire height of the seam. With such a construction, the level of the driving motor, which is fastened to the free end of the outer support arm section can be matched to the respective drum position. Furthermore, depending on the dimensions of the cutting drum and the motor, the motor may be pivoted into the cutting incision produced by the cutting drum. In this embodiment, the spacing between the longwall conveyor means and the discharge end of the cutting drum is minimized and the discharge of debris onto the conveyor is improved by this minimization.

In the third and fourth embodiments, the inner support arm section is positioned in a machine body cavity which is open toward an end face of the machine body. With such a construction, the pivoting of the inner support arm section is limited in the downward direction by the extended floor area of the machine body beneath the cavity or, if present, by the circumference of an auxiliary drum mounted at the end of the machine body.

DESCRIPTION OF THE PREFERRED EMBODIMENTS

Figure 1:
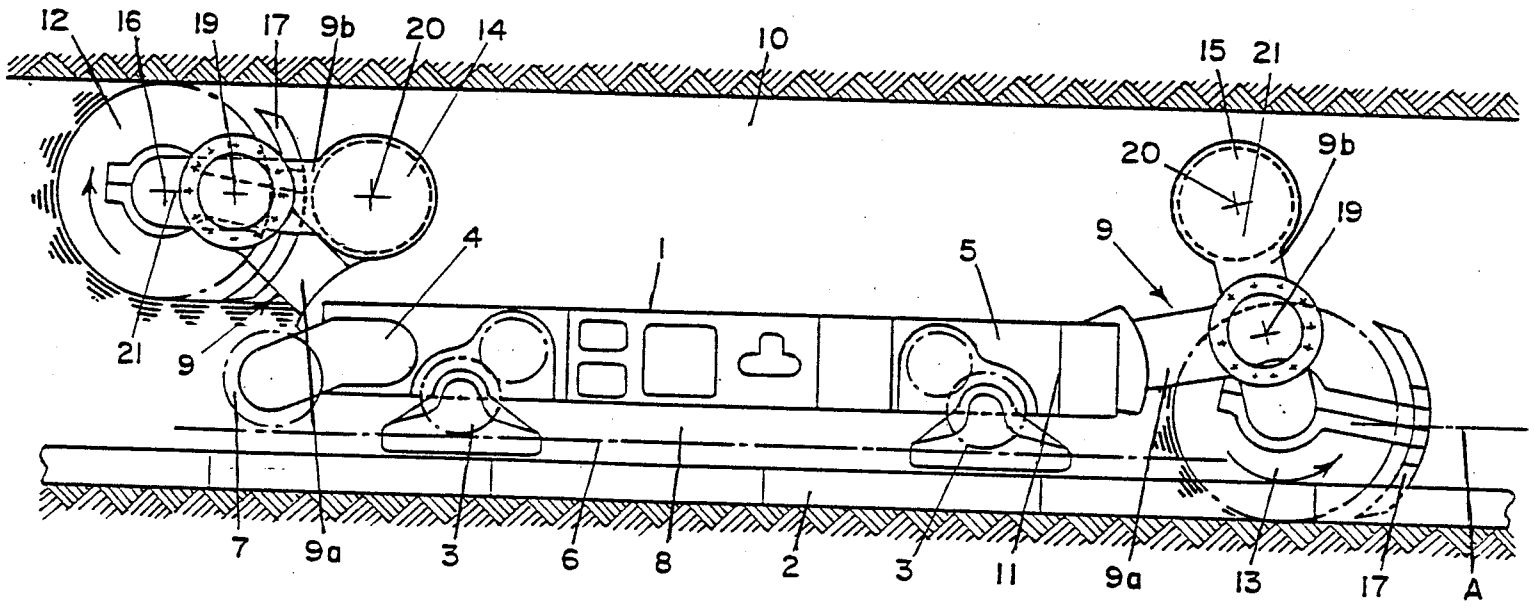
FIG. 1 is an elevational view of a first embodiment of the mining machine of the present invention.

Referring first to FIG. 1, there is depicted a drum cutter-loader mining machine generally designated as numeral 1. The cutter-loader 1 is positioned above a longwall conveyor means 2 and with the driving wheels 3 of its two winches 4 and 5 it engages in, and is transported along, a rack 6 which extends over the length of the longwall conveyor means 2. The end of the cutter-loader 1 which faces the direction of conveyance of the longwall conveyor means 2 is equipped with an auxiliary drum 7, which serves to crush the portions of debris projecting above the through-passage profile of the machine bridge 8. Each of the two ends of the machine body carries a support arm 9. Each support arm 9 is formed by two support arm sections **9*a* and 9*b*. The inner support arm section 9*a*, which is attached to the machine body, is pivotally mounted at one end thereof to the machine body so as to be pivotable about an axis 11 which is parallel to the mine floor and is pointed towards the coal face 10. In all of the figures the outer support arm section 9b is pivotally supported on a second or "free" end of the inner support arm section 9a. For purposes of simplicity, only the left or "leading" portion of the cutter-loader 1 will be described in detail in the descriptions of all of the drawing figures. It should be understood, however, that the description of the left or "leading" portion of the of the cutter-loader 1** applies also to the right or "trailing" portion thereof except where otherwise specified.

Still referring to the embodiment of FIG. 1, it can be seen that the outer support arm section 9b is pivotally supported near a central portion thereof on the free end of inner support arm section 9a. The outer support arm section 9b carries on one of its ends a cutting drum 12 and on its other end it carries cutting drum drive motor 14. Driving motor 14 and cutting drum 12 are situated on the same side of the outer support arm section 9b and are positioned inside the coal seam winning track. Motor 14 and drum 12 are connected together by an unillustrated gear train which is housed on the inside of the support arm section 9b. A dozer blade 17, which is pivotally mounted about the cutting drum axis 16, completely closes rearwardly the space which is cut free by the cutting drum 12 and assists the discharge of debris onto the longwall conveyor means 2 which is brought about by the helically-shaped driver flights 18 of the cutting drum 12.

A pivoting axis 19, which is parallel to the pivoting axis 11 of the inner support arm section 9a connects the outer support arm section 9b to the free end of the inner support arm section 9a. As noted previously, this pivoting axis 19, in the illustrated embodiment of FIG. 1, is between the axis 16 of the cutting drum 12 and the axis of rotation 20 of the driving motor 14. With the aid of an unillustrated bilaterally actuatable pressure cylinder, the inner support arm section 9a can be pivoted about the axis 11 and brought into its desired working position. The outer support arm section 9b on the other hand, is brought into its respective working position with the aid of an unillustrated gearing, located in the region of the pivoting axis 19 and housed inside the two support arm sections 9a and 9b. The gearing limits the pivoting path of the outer support arm section 9b to an angle which reaches 360° at maximum and hence to a range which can guide the cutting drum 12 completely around the pivoting axis 19. A prerequisite, however, is that the seam be of a thickness to permit such a pivoting, i.e., the seam thickness must be wider than the diameter of a circular path traced by the outermost point on either motor 14 or cutting drum 12 during pivoting of outer support arm section 9b. The outermost point is that point on either motor 14 or cutting drum 12 which is the greatest distance from pivoting axis 19 as measured along the longitudinal axis 21 of outer arm section 9b. By limiting the pivoting path of the outer support arm section 9b to 360°, the deformation of a power cable (not shown), via which the driving motor 14 is supplied with driving energy, remains in its permitted twist range, as the maximum torsional angle of the cable end does not exceed 180° either in one or the other pivoting direction of the support arm section 9b.

Figure 2:
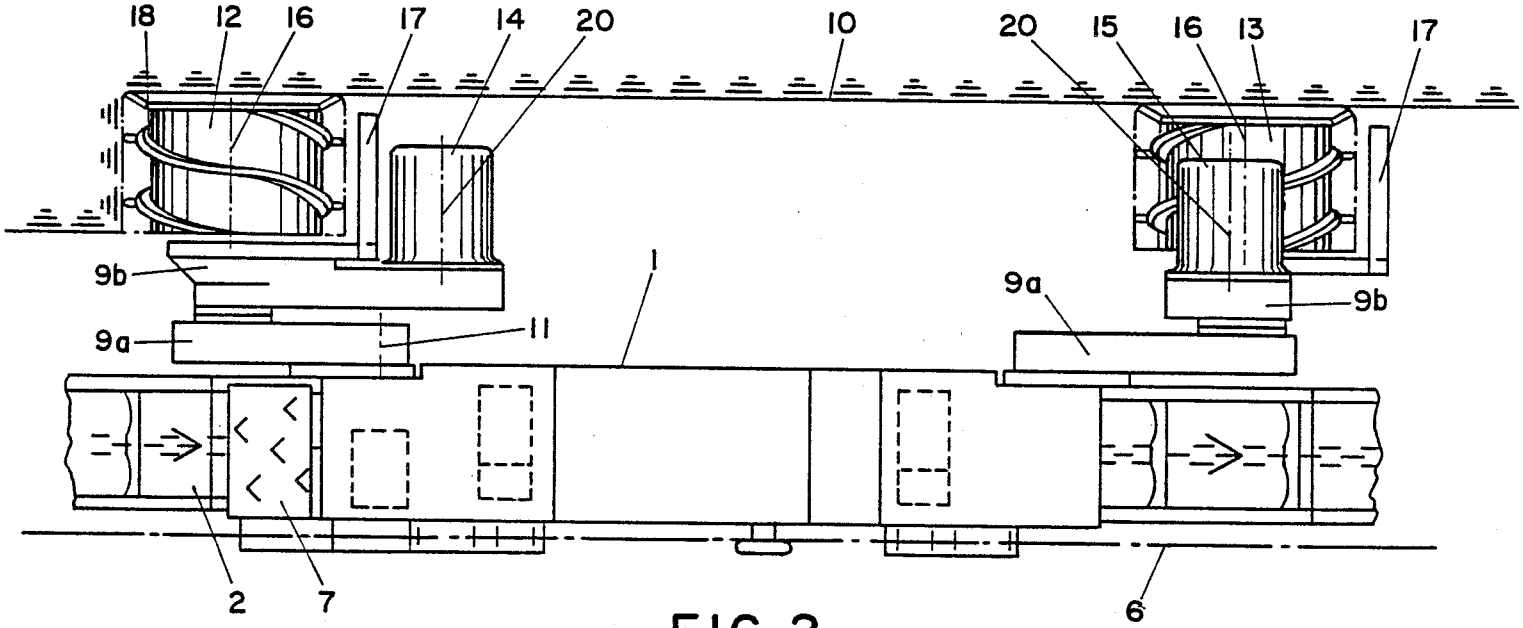
FIG. 2 is a top plan view of a second embodiment of the mining machine of the present invention.
Figure 3:
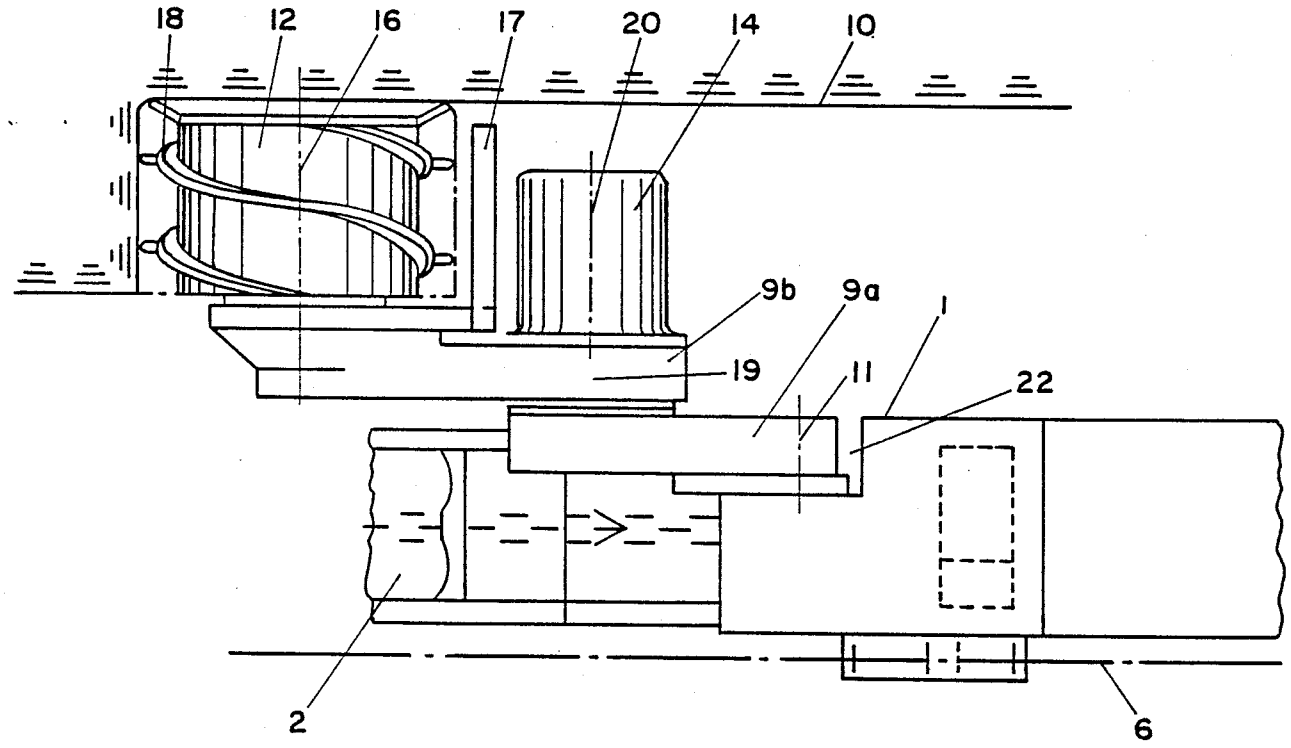
FIG. 3 is a top plan view of one end of a third embodiment of the mining machine of the present invention.

The embodiments of FIGS. 2 and 3 illustrate that it is also possible to arrange the pivoting axis 19 coaxially with either the cutting drum axis 16, as illustrated in FIG. 2, or coaxially with the motor axis 20, as illustrated in FIG. 3. The embodiments of the invention depicted in FIGS. 2 and 3 fully maintain the advantageous 360° adjustability of the outer support arm section 9b as described hereinabove with regard to FIG. 1.

Figure 4:
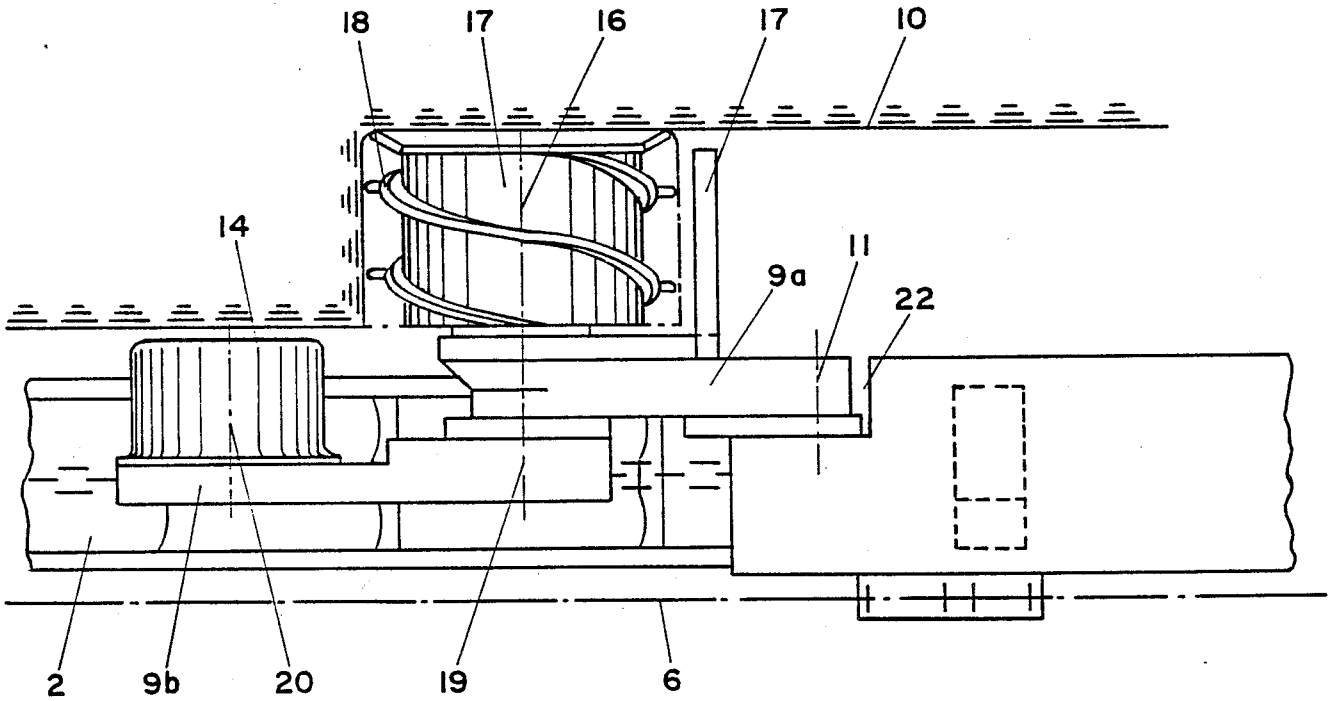
FIG. 4 is a top plan view of one end of a fourth embodiment of the mining machine of the present invention.

In the illustrated embodiments of FIGS. 3 and 4, inner support arm section 9a is situated in a cavity 22 of the machine body which is at least as wide as the inner support arm section 9a and which is open toward the coal face and the end of the machine body. This cavity 22 can also be located on the goaf side of the machine body so that the outer support arm section 9b is situated closely beside or even above the longwall conveyor means 2. By the provision of such a cavity, the lateral spacing between the discharge end of the cutting drum 12 and the longwall conveyor means 2 is reduced and the efficiency of the discharge of debris from the cutting drum 12 to the conveyor 2 is improved. Advantageously, with such a support arm arrangement, the pivoting range of the inner support arm section 9a is limited in a downward direction by an extended area of the machine body floor beneath the cavity 22 defining a plane "A" (FIG. 1) which is identical to the floor height of the machine body. Such limiting of the pivoting range of the inner support arm section 9a advantageously avoids narrowing of the debris pass-through cross-section of the machine bridge caused by excessive lowering of the inner support arm section 9a. Furthermore, if an auxiliary drum 7 is provided above the longwall conveyor means 2, its circumferential wall should serve as a limit for the lowest permitted pivoting position of the inner support arm section 9a in order to preclude collisions between the support arm section 9a and the auxiliary drum 7.

FIG. 4 shows an embodiment in which the inner support arm section 9a carries the outer support arm section 9b on its goaf side opposite the coal face 10. In this embodiment, the cutting drum 12 is situated coaxially with the pivoting axis 19 which connects the two support arm sections 9a and 9b together in an articulated manner. The task falling to the outer support arm section 9b in this embodiment is to carry the driving motor 14 and swivel itself and the driving motor 14 into a working position in which they do not impede the discharge of debris from the cutting drum 12. With this particular design, the lateral spacing between longwall conveyor means 2 and the discharge end of the cutting drum 12 assumes a minimum dimension. At the same time, the center of gravity position of the drum cutter-loader 1 is improved by the placement of more of the cutter-loader machine structure above, rather than laterally beside, the longwall conveyor means 2.

Figure 5:
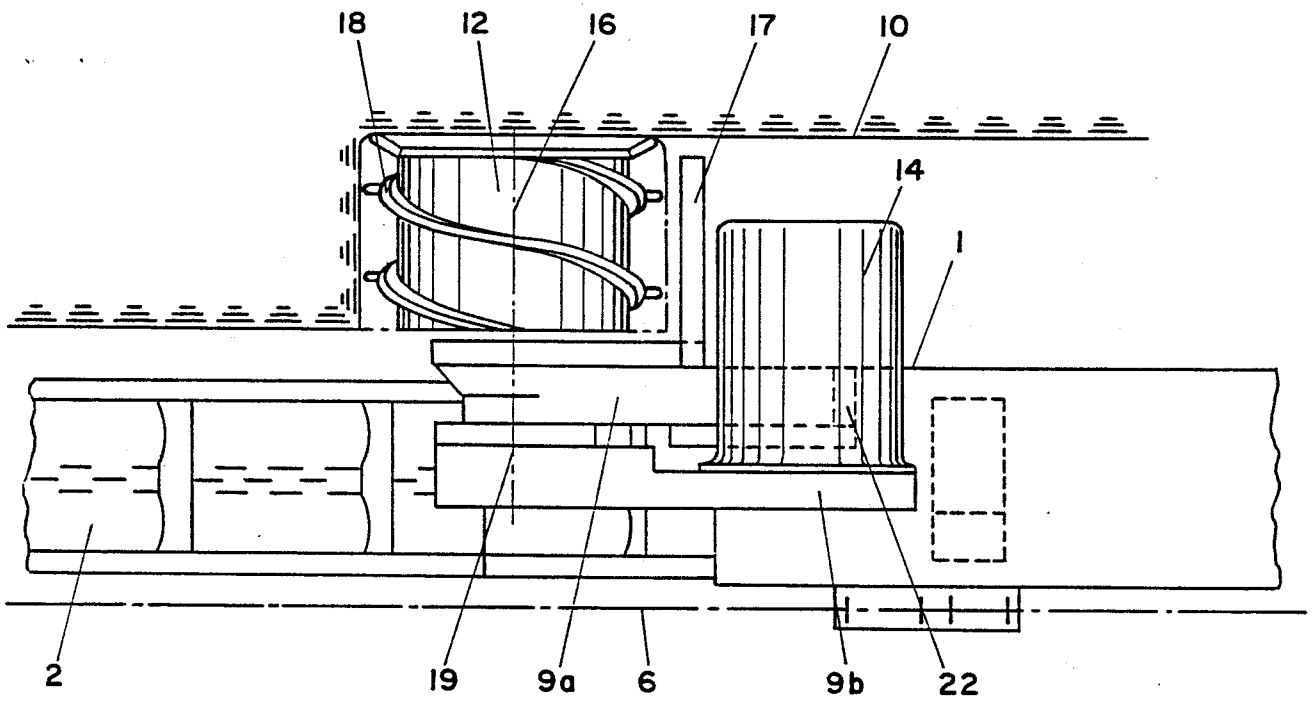
FIG. 5 is a top plan view showing the positioning of an elongated motor which may be usable with the fourth embodiment of the invention.

FIG. 5 shows a slight variation of the FIG. 4 embodiment illustrating the positioning of an elongated drive motor 14 inside the coal seam winning track behind the cutting drum 12 in a manner similar to that shown in the FIG. 1 through FIG. 3 embodiments.

While the present invention has been described in accordance with the preferred embodiments of the various figures, it is to be understood that other similar embodiment may be used or modifications and additions may be made to the described embodiment for performing the same functions of the present invention without deviating therefrom. Therefore, the present invention should not be limited to any single embodiment but rather construed in breadth and scope in accordance with the recitation of the appended claims.

We claim:

1. A drum cutter-loader mining machine comprising:

a machine body;

at least one support arm pivotally mounted to one end of said machine body and supporting a first rotatable cutting drum thereon, said at least one support arm comprising a first arm section pivotally mounted at one end thereof to said machine body and a second arm section pivotally mounted to said first arm section at an end of said first arm section opposite to said one end; and motor means carried by said second arm section for driving said first cutting drum.

2. The machine of claim 1 wherein said second arm section is arranged on a coal face side of the first arm section.

3. The machine of claim 2 wherein said second arm section carries said motor means at a first end thereof and said first cutting drum at a second end thereof.

4. The machine of claim 3 wherein said second arm section is pivotally mounted to said first arm section at a location intermediate said motor means and said first cutting drum.

5. The machine of claim 4 further comprising gearing means actable upon said second arm section for limiting the pivoting range thereof to an angle of 360°.

6. The machine of claim 3 wherein said second arm section is pivotally mounted to said first arm section about a pivot axis at said first end of said second arm section, whereby said pivot axis is coaxial with the axis of rotation of said motor means.

7. The machine of claim 6 further comprising gearing means actable upon said second arm section for limiting the pivoting range thereof to an angle of 360°.

8. The machine of claim 3 wherein said second arm section is pivotally mounted to said first arm section about a pivot axis at said second end of said second arm section, whereby said pivot axis is coaxial with the axis of rotation of said first cutting drum.

9. The machine of claim 8 further comprising gearing means actable upon said second arm section for limiting the pivoting range thereof to an angle of 360°.

10. The machine of claim 2 further comprising:

cavity means formed in said machine body, said first arm section being positioned in said cavity means, said cavity means being open toward the end of said machine body to which said first arm section is pivotally mounted, said cavity means being at least as wide as said first arm section; and means for limiting the downward pivoting range of said first arm section.

11. The machine of claim 10 wherein said limiting means comprise an area of the machine body floor beneath said cavity means.

12. The machine of claim 10 further comprising:

auxiliary drum means carried at said one end of said machine body, wherein said limiting means comprise a circumferantial wall of said auxiliary drum means.

13. The machine of claim 1 further comprising a second support arm pivotally mounted to said machine body at an end opposite said one end and supporting a second rotatable cutting drum thereon, said second support arm comprising a first arm section pivotally mounted at one end thereof to said machine body and a second arm section pivotally mounted to said first arm section at an end of said first arm section opposite to said one end; and motor means carried by said second support arm for driving said second cutting drum.

14. The machine of claim 1 wherein said second arm section is arranged on a goaf side of the first arm section.

15. The machine of claim 14 wherein said second arm section is pivotally mounted to said first arm section about a pivot axis at a first end of said second arm section, said second arm section carrying said motor means at a second end thereof, said first arm section carrying said first cutting drum on a coal face side thereof and at said end opposite to said one end, whereby said pivot axis is coaxial with the axis of rotation of said first cutting drum.

16. The machine of claim 14 further comprising:

cavity means formed in said machine body, said first arm section being positioned in said cavity means, said cavity means being open toward the end of said machine body to which said first arm section is pivotally mounted, said cavity means being at least as wide as said first arm section; and means for limiting the downward pivoting range of said first arm section.

17. The machine of claim 16 wherein said limiting means comprise an area of the machine body floor beneath said cavity means.

18. The machine of claim 16 further comprising:

auxiliary drum means carried at said one end of said machine body, wherein said limiting means comprise a circumferential wall of said auxiliary drum means.

19. The machine of claim 14 further comprising a second support arm pivotally mounted to said machine body at an end opposite said one end and supporting a second rotatable cutting drum thereon, said second support arm comprising a first arm section pivotally mounted at one end thereof to said machine body and a second arm section pivotally mounted to said first arm section at an end of said first arm section opposite to said one end; and motor means carried by said second support arm for driving said second cutting drum.

20. The machine of claim 1 wherein said motor means is flange mounted to the exterior of said second arm section.

* * * * *